US008782929B2

(12) United States Patent
Taicher

(10) Patent No.: US 8,782,929 B2
(45) Date of Patent: Jul. 22, 2014

(54) SHOE OUTSOLE WITH CUT-OUT HEEL REGION

(76) Inventor: Don Taicher, Santa Monica, CA (US)

( * ) Notice: Subject to any disclaimer, the term of this patent is extended or adjusted under 35 U.S.C. 154(b) by 502 days.

(21) Appl. No.: 12/291,873

(22) Filed: Nov. 13, 2008

(65) Prior Publication Data

US 2010/0115797 A1 May 13, 2010

(51) Int. Cl.

| | |
|---|---|
| ***A43B 13/14*** | (2006.01) |
| ***A43B 21/00*** | (2006.01) |
| ***A43B 21/26*** | (2006.01) |
| ***A43B 7/14*** | (2006.01) |

(52) U.S. Cl.

CPC ..... *A43B 21/26* (2013.01); *A43B 13/146* (2013.01); *A43B 7/144* (2013.01)

USPC ..... 36/105; 36/106; 36/34 R

(58) Field of Classification Search

USPC ..... 36/105, 106, 58.6, 34 R, 103, 25 R, 102; D2/924, 968

See application file for complete search history.

(56) References Cited

U.S. PATENT DOCUMENTS

| | | | | | |
|---|---|---|---|---|---|
| D95,767 | S | * | 5/1935 | Marks | D2/965 |
| D97,311 | S | * | 10/1935 | Troy | D2/923 |
| D102,344 | S | * | 12/1936 | Stein | D2/931 |
| 2,449,294 | A | * | 9/1948 | Guindon | 36/34 R |
| 2,635,364 | A | * | 4/1953 | Meingast | 36/72 R |
| 3,170,248 | A | * | 2/1965 | Levine | 36/106 |
| 3,822,490 | A | * | 7/1974 | Murawski | 36/105 |
| 5,138,766 | A | * | 8/1992 | Kimura et al. | 29/895.212 |
| 5,694,706 | A | * | 12/1997 | Penka | 36/103 |
| 6,061,930 | A | * | 5/2000 | Zinovieff | 36/115 |
| 6,962,008 | B2 | * | 11/2005 | Manz et al. | 36/25 R |
| 2004/0148797 | A1 | * | 8/2004 | Nelson, Jr. | 36/8.3 |
| 2005/0120592 | A1 | * | 6/2005 | Rodriguez | 36/35 R |
| 2008/0244932 | A1 | * | 10/2008 | Nau | 36/102 |

* cited by examiner

*Primary Examiner* — Jila M Mohandesi

(74) *Attorney, Agent, or Firm* — Tope-McKay & Associates

(57) ABSTRACT

The present invention relates to an outsole for a shoe which lessens the impact on a wearer's heel region to aid in preventing and treating heel spurs. The rear portion of the outsole comprises a heel region having a cut-out in a center part of the heel region such that the center part of the heel region never contacts a surface when worn. This aspect is central to the function of the present invention since the positioning of the cut-out eliminates impact on a wearer's heels. Rather, pressure from impact is distributed from the center of the heel to the outer edges of the heel region which symmetrically flank the cut-out. Finally, the present invention relates to a shoe comprising an upper attached with an outsole or formed as one piece with an outsole as previously described.

16 Claims, 4 Drawing Sheets

SHOE OUTSOLE WITH CUT-OUT HEEL REGION

BACKGROUND OF THE INVENTION (1) Field of Invention

The present invention relates to a shoe outsole and, more particularly, to a shoe outsole which lessens the impact on a wearer's heel region.

(2) Description of Related Art

Heel spurs develop as an abnormal growth of the heel bone and are common in athletes or those who have active lifestyles due to excessive stress or overuse of the plantar fascia ligament. Common treatments for heel spurs include elevating the heel with the use of a shoe inserts such as heel cradles, heel cups, or orthotics. Since these shoe inserts are removably positioned inside the shoe, they can easily shift inside the shoe or be misplaced. Additionally, due to close contact with the wearer's foot, the shoe inserts require frequent replacement due to wear.

Thus, a continuing need exists for a heel spur prevention and treatment device formed as part of a shoe which does not need to be continuously repositioned in the shoe or replaced due to wear.

SUMMARY OF INVENTION

The present invention relates to an outsole for a shoe which lessens the impact on a wearer's heel region. The outsole comprises a front portion, a rear portion, and a center portion located between the front portion and the rear portion. The rear portion of the outsole comprises a heel region having a cut-out in a center part of the heel region.

In another aspect, the cut-out extends through the rear portion of the outsole.

In another aspect, the cut-out comprises a rounded portion proximate the center portion of the outsole.

In another aspect, the cut-out is U-shaped.

In yet another aspect, the cut-out is horseshoe-shaped.

The present invention also relates to a shoe comprising an upper attached with an outsole for a shoe as previously described.

The present invention also relates to a shoe comprising an upper and an outsole for a shoe as previously described formed as one piece.

Finally, as can be appreciated by one in the art, the present invention also comprises a method for forming the outsole for a shoe described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
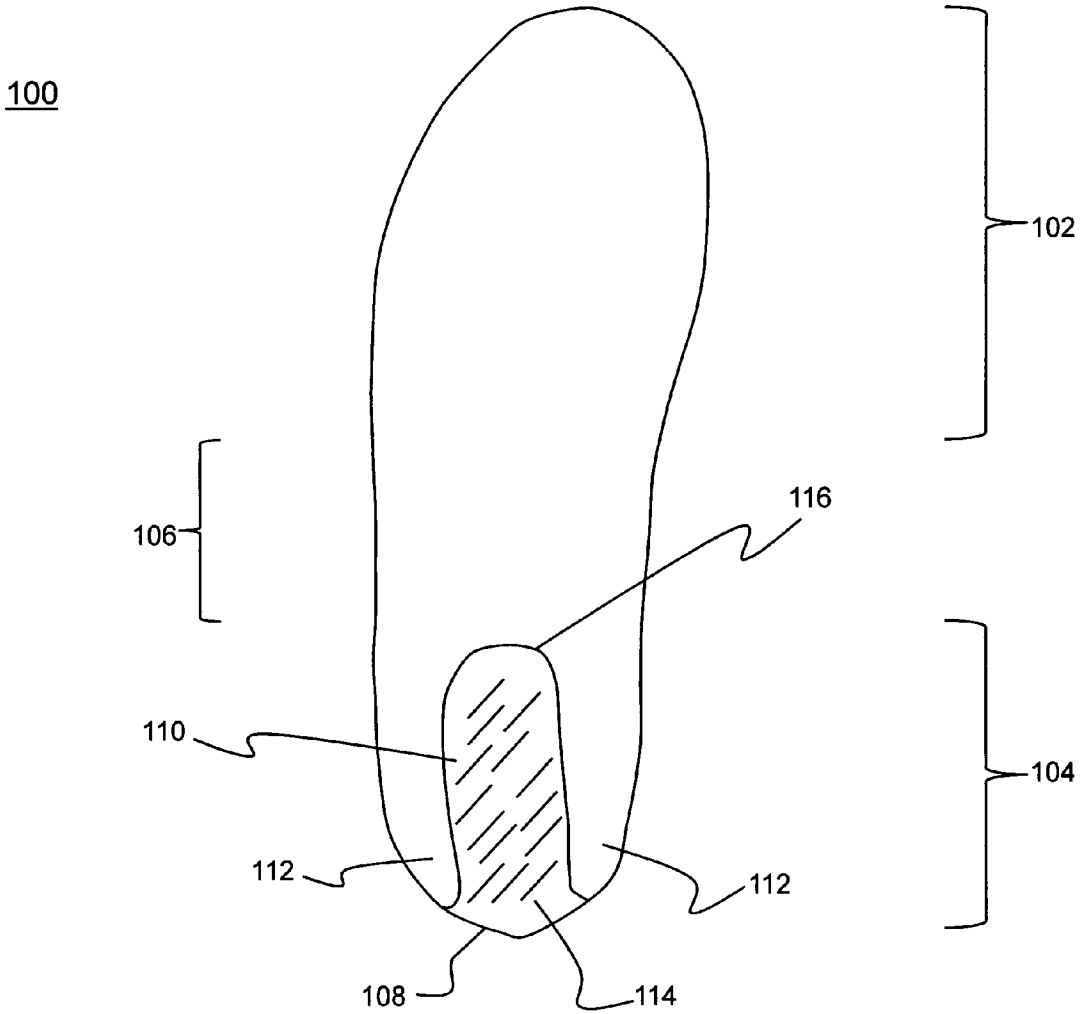
FIG. 1 is a bottom-view illustration of an outsole for a shoe which lessens the impact on a wearer's heel region showing the cut-out in a center portion of the heel region as U-shaped according to the present invention.

The present invention relates to a shoe outsole and, more particularly, to a shoe outsole which lessens the impact on a wearer's heel region. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a shoe sole having a cut-out heel region to prevent heel spurs in the wearer. In order to best describe the function of the present invention, an overview of the cause and treatment of heel spurs is required. The heel bone is the largest bone in the foot and absorbs the greatest amount of shock and pressure. A heel spur develops as an abnormal growth of the heel bone. Calcium deposits form when the plantar fascia ligament pulls away from the heel area causing a bony protrusion, or heel spur, to develop. Heel spurs can cause extreme pain in a person's heel region, particularly while the person is standing or walking. Athletes or those who have active lifestyles are especially prone to heel spurs due to regular running, jumping, or any activity that can cause the plantar fascia ligament to stretch or overextend. Common treatments for heel spurs include stretching exercises, wearing shoes that have a cushioned heel to absorb shock, and elevating the heel with the use of a heel cradle, heel cup, or orthotic.

FIG. 1 depicts a bottom-view illustration of an outsole 100, or shoe bottom, for a shoe having a front portion 102, a rear portion 104, and a center portion 106 located between the front portion 102 and the rear portion 104. The rear portion 104 of the outsole 100 comprises a heel region 108 having a cut-out 110 therein. In a desired aspect and as shown in FIG. 1, the cut-out 110 extends through the rear portion 104 of the outsole 100. Additionally, the cut-out 110 is formed in a center part of the heel region 108 such that the center part of the heel region 108 never contacts a surface when worn. This aspect is central to the function of the present invention since the positioning of the cut-out 110 eliminates impact on a wearer's heels. Rather, pressure from impact is distributed from the center of the heel to the outer edges 112 of the heel region 108 which flank the cut-out 110.

Furthermore, the cut-out 110 is formed such that it does not extend through the entire depth of the outsole 100 so that a protective layer 114 (patterned region) of outsole 100 remains to prevent any injury to the heel of the wearer. The protective layer 114 of the outsole 100 supports both the outer edges 112 of the heel region 108 and prevents the heel of the wearer from descending to the surface below by supporting an upper attached to the outsole. Additionally, the dimensions of the cut-out 110 from top to bottom are formed such that there is a distance between the heel of the wearer and a walking or running surface, sufficient such that the heel of the wearer does not ever contact the surface. The outsole 100 may be formed from any suitable durable material, non-limiting examples of which include rubber, polyurethane, and ethyl vinyl acetate. In a desired aspect, the outsole 100 comprises a single piece of material; however, the outsole 100 may also comprise several layers of material permanently attached to one another.

As can be appreciated by one skilled in the art, the dimensions of the cut-out 110 may vary depending on the size of the outsole 100 and the heel region 108 for a particular shoe. As a non-limiting example, the cut-out 110 may be approximately one to three inches in length depending on the length of the heel region 108 of the outsole 100. For all outsoles 100, the cut-out 110 spans the heel region 108, but does not extend into the center portion 106 of the outsole 100 where the arch of the wearer's foot would be positioned.

Figure 2:
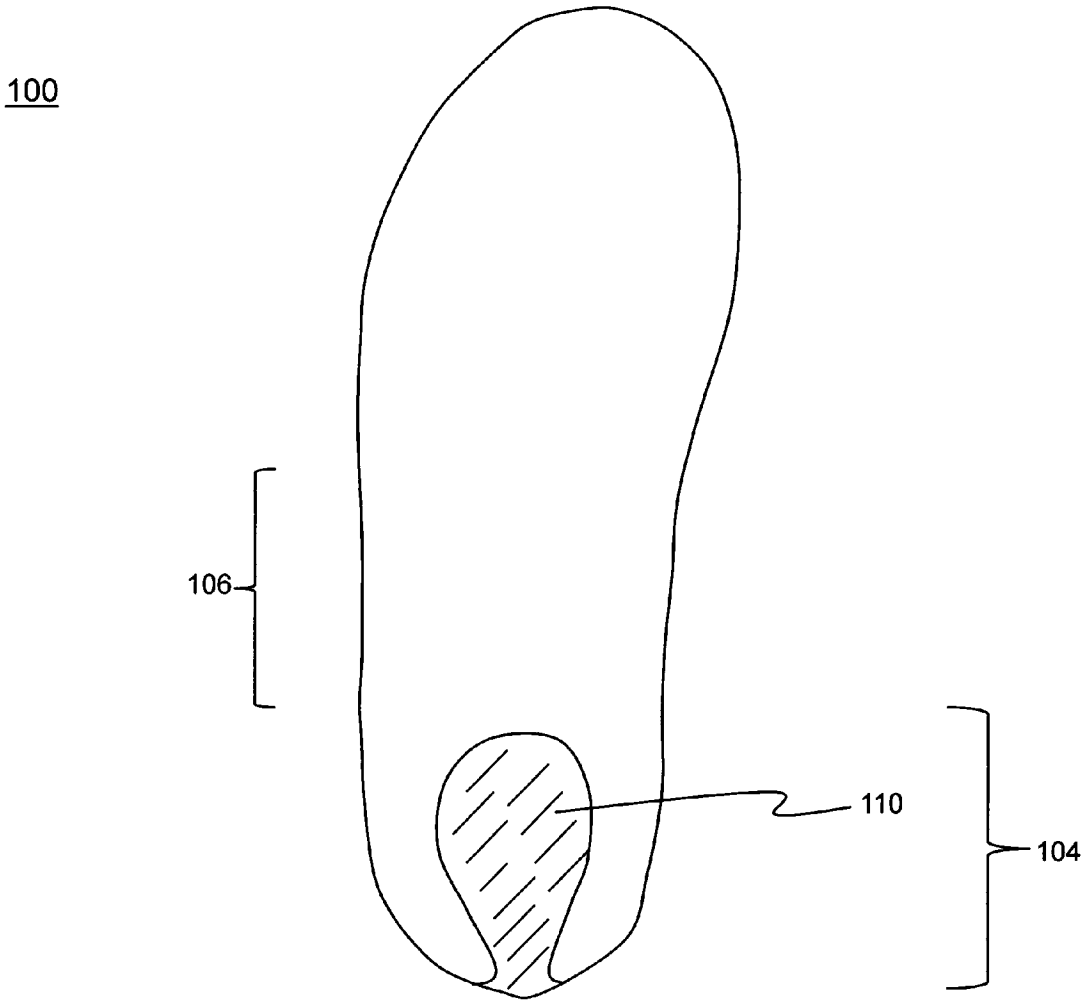
FIG. 2 is a bottom-view illustration of an outsole which lessens the impact on a wearer's heel region showing the cut-out as horseshoe-shaped according to the present invention.

In a desired aspect, the cut-out 110 comprises a closed, rounded portion 116 proximate the center portion 106 of the outsole 100, which may be U-shaped as shown in FIG. 1. Alternatively, as illustrated in FIG. 2, the cut-out 110 may be horseshoe-shaped.

Figure 3:
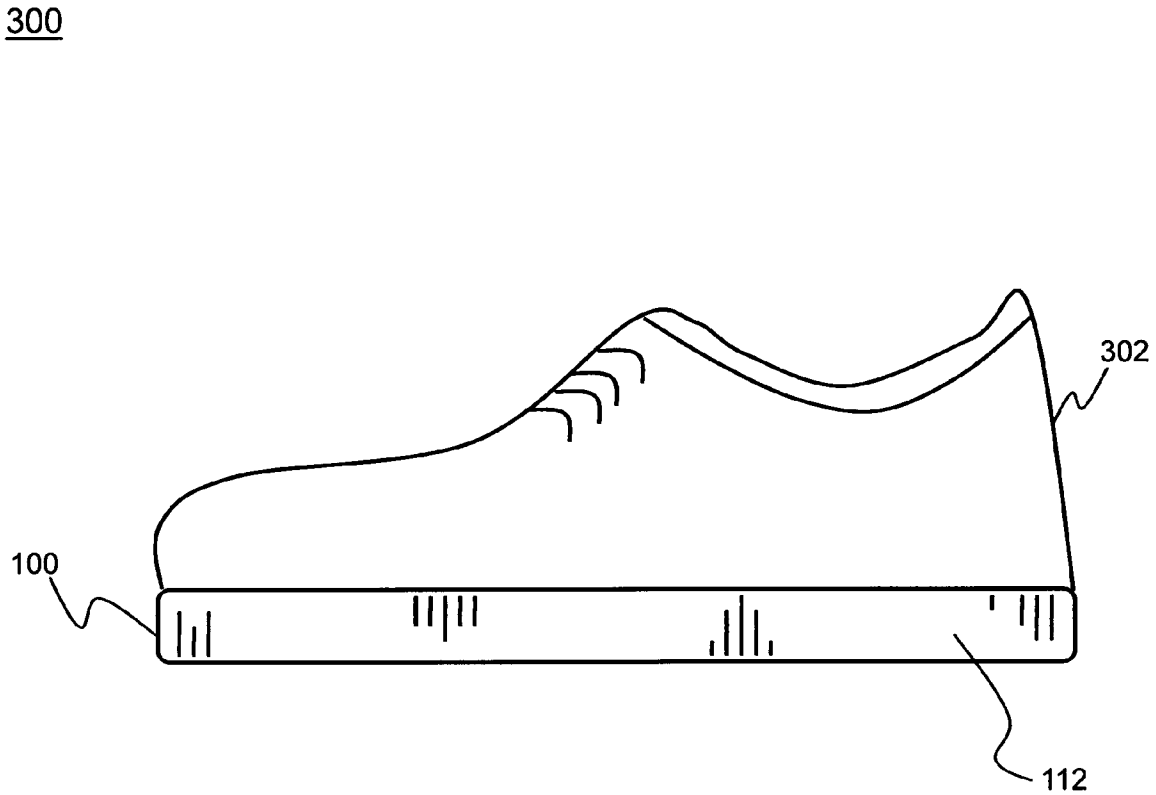
FIG. 3 is a side-view illustration of a shoe having an outsole which lessens the impact on a wearer's heel region according to the present invention.

FIG. 3 is a side-view illustration of a shoe 300 which comprises an upper 302 attached with an outsole 100 as described above. As a non-limiting example, the shoe 300 is depicted as a running shoe. However, as can be appreciated by one skilled in the art, the shoe 300 may be any type of athletic shoe or leisure shoe which would be improved by an outsole 100 which lessens the impact on a wearer's heel region. As depicted in FIG. 3, the cut-out (not shown) is not visible from a side view of the shoe 300. Only an outer edge 112 of the heel region 108 is visible such that the outsole 100 appears to be a typical outsole 100 from this viewpoint.

Figure 4:
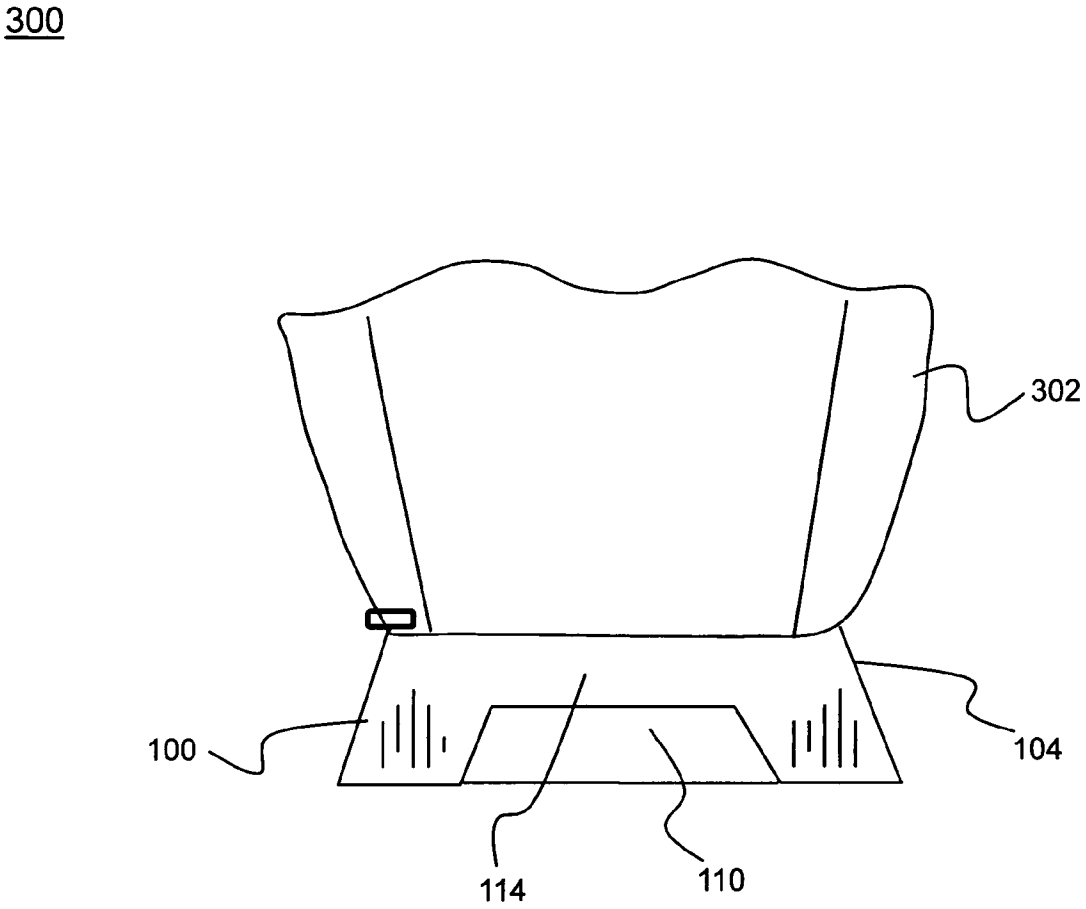
FIG. 4 is a rear-view illustration of a shoe having an outsole which lessens the impact on a wearer's heel region showing a cut-out in the heel region which extends through the rear portion of the outsole according to the present invention.

FIG. 4 is a rear-view illustration of the cut-out 110 in the outsole 100. In a desired aspect and as shown, the outsole 100 is attached with a shoe 300 which comprises an upper 302. From this viewpoint, the cut-out 110 in the outsole 100 is clearly visible. In a desired aspect, the cut-out 110 extends completely through the rear portion 104 of the outsole 100. Furthermore, the protective layer 114 of the outsole 100, as described previously, is visible from this viewpoint as well.

What is claimed is:

1. An outsole for a shoe which lessens the impact on a wearer's heel region, the outsole comprising:

a top and a bottom, a front portion, a rear portion, and a center portion located between the front portion and the rear portion;

wherein the rear portion of the outsole comprises a heel region having a cut-out in a center part of the heel region; and wherein the cut-out extends from an epicenter of the heel region to an end of a rear of the heel region through a portion of the outsole between the top and through the bottom of the outsole and opens only toward the rear portion and bottom of the outsole, forming sidewall portions about the cut-out which are open toward and proximate the rear and toward the bottom of the outsole, where the sidewalls have a ground contacting surface, leaving a portion of the bottom of the outsole and a portion of the rear portion of the outsole open.

2. An outsole for a shoe as set forth in claim 1, wherein the cut-out comprises a rounded portion proximate the center portion of the outsole.

3. An outsole for a. shoe as set forth in claim 1, wherein the cut-out extends through the rear portion of the outsole.

4. An outsole for a shoe as set forth in claim 2, wherein the cut-out is U-shaped.

5. An outsole for a shoe as set forth in claim 2, wherein the cut-out is horseshoe-shaped.

6. An outsole for a shoe as set forth in claim 2, wherein the cut-out extends through the rear portion of the outsole.

7. A shoe, comprising:

an upper attached with an outsole for a shoe as set forth in claim 1.

8. A shoe, comprising:

an upper and an outsole for a shoe as set forth in claim 1 formed as one piece.

9. A method for forming an outsole for a shoe which lessens the impact on a wearer's heel region, comprising acts of:

forming an outsole having a top and a bottom, a front portion, a rear portion, and a center portion located between the front portion and the rear portion;

forming the rear portion of the outsole to comprise a heel region having a cut-out in a center part of the heel region; and forming the cut-out to extend from an epicenter of the heel region to an end of a rear of the heel region through at least a portion of the outsole between the top and through the bottom of the outsole and opening only toward the rear portion and bottom of the outsole, forming sidewall portions about the cut-out which are open toward and proximate the rear and toward the bottom of the outsole where the sidewall portions have a ground contacting surface, leaving a portion of the bottom of the outsole and a portion of the rear portion of the outsole open.

10. A method for forming an outsole for a shoe as set forth in claim 9, further comprising the act of forming the cut-out to have a rounded portion proximate the center portion of the outsole.

11. A method for forming an outsole for a shoe as set forth in claim 9, further comprising the act of forming the cut-out such that it extends through the rear portion of the outsole.

12. A method for forming an outsole for a shoe as set forth in claim 10, further comprising the act of forming the cut-out to be U-shaped,

13. A method for forming an outsole for a shoe as set forth in claim 10, further comprising the act of forming the cut-out to be horseshoe-shaped.

14. A method for forming an outsole for a shoe as set forth in claim 10, further comprising the act of forming the cut-out such that it extends through the rear portion of the outsole.

15. An outsole as set forth in claim 1, where the cut-out is formed of a shape selected from a group consisting of square shapes, rectangular shapes, trapezoidal shapes, and horse-shoe shapes with an apex of the horse-shoe shape proximate the epicenter of the heel region and the opening of the horse-shoe shape opening at the rear portion of the outsole.

16. A method for forming an outsole for a shoe as set forth in claim 9, where the cut-out is formed of a shape selected from a group consisting of square shapes, rectangular shapes, trapezoidal shapes, and horse-shoe shapes with an apex of the horse-shoe shape proximate the epicenter of the heel region and the opening of the horse-shoe shape opening at the rear portion of the outsole.

* * * * *